United States Patent [19]

Adler et al.

[11] Patent Number: 4,767,943

[45] Date of Patent: Aug. 30, 1988

[54] SWITCH ARRANGEMENT

[75] Inventors: Bernhard Adler, Rastatt; Hermann Kieferle, Ettlingen, both of Fed. Rep. of Germany

[73] Assignee: Stierlen-Maquet AG, Fed. Rep. of Germany

[21] Appl. No.: 1,146

[22] Filed: Jan. 7, 1987

[30] Foreign Application Priority Data

Jan. 18, 1986 [DE] Fed. Rep. of Germany ..... 3601363

[51] Int. Cl.[4] ..... H01H 35/00; H01H 13/64

[52] U.S. Cl. ..... 307/119; 307/112; 200/159 B

[58] Field of Search ..... 307/119, 112; 200/159 B, 5 A, 5 E

[56] References Cited

U.S. PATENT DOCUMENTS 3,917,917 11/1975 Murata ..... 200/5 A 4,349,712 9/1982 Michalski ..... 200/159 B

OTHER PUBLICATIONS

Anderson et al, *Designing with TTL Integrated Circuits*, pp. 3–4, 1971.

*Primary Examiner*—William M. Shoop, Jr.

*Assistant Examiner*—Sharon D. Logan

[57] ABSTRACT

In a switch arrangement for switching electrical functions with at least two switches (A;B) having electrical contact elements (8;9;10;11), at least one of the switches (A;B) is made as a foil switch having a flexible base foil (4;7) carrying one contact element (9;11) and a switch element (2;5), particularly a switch foil, elastically deflectable in the direction toward the base foil and carrying the opposite contact element (8;10). The other switch (B) is so arranged behind the foil switch (A) in the keying direction that it is operable by an operating pressure on the foil switch (A) which exceeds the required operating pressure for the foil switch (A).

1 Claim, 2 Drawing Sheets

SWITCH ARRANGEMENT

BACKGROUND OF THE INVENTION

The invention relates to a switch arrangement for switching electrical functions with switches having at least two electric contact elements, and it especially concerns an arrangement of at least two switches wherein the two switches are located adjacent one another and are so constructed as to be operated essentially simultaneously in response to a single finger press or the like by the operator, such arrangement, for example being desireable for use in controlling the movement functions of an apparatus for supporting patients.

In the case of patient supporting apparatus, motorized adjustable movement functions for changing the positions of patients frequently are switched by existing double electrical switch circuits independent of one another. If a fault occurs in one of the electrical circuits the movement of the support apparatus is immediately stopped or not carried out. The reason for this is that any danger to a patient from a faulty movement function of the supporting apparatus must be prevented.

It is already known to provide, in a switch or service unit for a patient support apparatus, two switches for operating the separate switch circuits, in which case the desired movement function of the patient support apparatus can only be carried out if both of the switches are actuated. This especially provides an assurance that a movement of the support apparatus can be interrupted in any event, even if in one of the switches the contact elements at a given time remain stuck to one another or the like. This solution involves however an increased surface requirement for the switch unit, and therewith a corresponding constructional size, since this switch unit for the plurality of movement modes of the support apparatus has a corresponding plurality of switches whose operating elements can not arbitrarily be made smaller. Moreover, the operation of two switches at the same time is troublesome.

The invention has as its object the provision of a switch arrangement of the aforementioned type which with regard to the avoidance of the previously described disadvantages has a low space requirement and makes possible an easy operation.

This object is solved in accordance with the invention in that at least one switch is made as a foil switch having a flexible base foil carrying one contact element and a switch element, particularly a switch foil, having an opposing contact element and elastically deflectable toward the contact element of the base foil, and in that the other switch is arranged behind the foil switch in the keying direction, so that the second switch is operable by a pressure on the foil switch which exceeds the pressure needed to operate the foil switch.

Therefore, for a switch arrangement according to the invention, for example in a switch device, only the area associated with the key surface of the foil switch is required. Also, the heigth of the switch arrangement in the keying direction is very small, since the foil switch itself requires only a small amount of space. By pressing on the foil switch it itself is first actuated. By further pressure on the flexible foil switch the electrical switch arranged below or behind it can then also be operated. This rear switch likewise can be made as a foil switch or also can be made as a mechanical pressure switch. In the case of several rearwardly arranged foil switches it is advantageous, with respect to the heigth of the entire switch arrangement, if the base foil of the forwardly lying foil switch forms the switch foil of the following foil switch in the keying direction.

Basically, it is possible to connect the switch arrangement of the invention in a switch circuit so that all of the switches in the same switch circuit are in series with one another. For the above-mentioned special application it is preferable if the switches are arranged in separate switch circuits which are connected with the inputs of an AND-gate whose output signal first controls a movement function of the support apparatus. So long as not all of the switches are simultaneously engaged the movement function of the support apparatus can be interrupted in all events, even if in one of the switches the contact elements remain unwantedly closed, as for example in the case of their being stuck to one another.

The invention is explained in more detail in the following description, in connection with the accompanying drawings, with respect to embodiments of the invention.

DETAILED DESCRIPTION OF PREFERRED EMBODIMENTS

In FIGS. 1 through 5 similar parts are provided with similar reference numbers.

Figure 1:
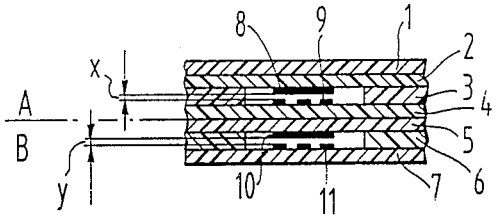
FIG. 1 is a view showing an example of two foil switches arranged above one another.

Two foil switches A and B, arranged above one another, are illustrated in FIG. 1, in which case the first actuated foil switch A consists of a flexible front foil 1, a flexible switch foil 2, a spacer foil 3, and a flexible base foil 4, the switch foil 2 having arranged thereon conducting contacts 8 and the base foil 4 having arranged thereon conducting contacts 9. The contacts 8 and 9 in the at rest condition have a spacing x from one another. The foil switch B arranged behind the foil switch A consists of a flexible switch foil 5, with conducting contacts 10, a spacing foil 6, and a base foil 7, with conducting contacts 11. The contacts 10 and 11 have in the at rest condition a spacing y from one another.

Figure 2:
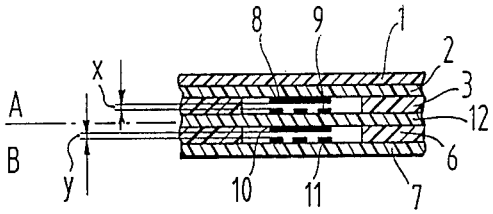
FIG. 2 is a view showing a modified embodiment of two foil switches arranged above one another.

Two foil switches A and B arranged above one another are shown in FIG. 2, in which case the flexible base foil 4 of the foil switch A and the flexible switch foil of the foil switch B are replaced by a flexible combination foil 12. On the one side of the combination foil are the conducting contacts 9 of the foil switch A, and the other side of the combination foil 12 are the conducting contacts 10 of the foil switch B. The contacts 9 and 10 in this case are however electrically non-conductively separated from one another.

Figure 3:
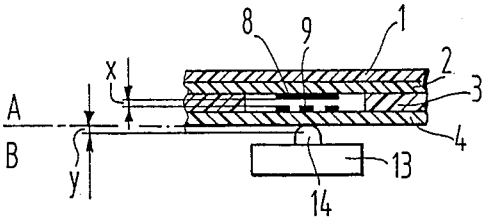
FIG. 3 is a view of a switch arrangement with a foil switch and with a mechanical switch arranged below the foil switch.

A foil switch A and another electrical push switch B arranged beneath it are shown in FIG. 3. Foil switch A consists of a flexible front foil 1, a flexible switch foil 2, with conducting contacts 8, a spacing foil 3, and a flexible base foil 4, with conducting contacts 9. The other underlying electrical switch or key B can consist of a housing 13 and can for example be operated by a stud 14.

Figure 4:
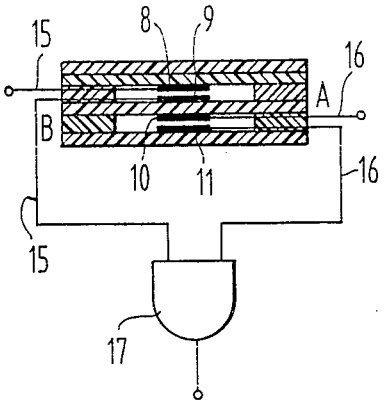
FIG. 4 is a view of a switching example for the switch arrangement of the invention.

FIG. 4 shows again a switch arrangement according to FIG. 2, with two foil switches A and B arranged behind one another. The contact elements 8 and 9 of the foil switch A are switched in the conductor 15. Th contact elements 10 and 11 of the foil switch B are switched in the conductor 16. The conductors 15 and 16 are connected to the inputs of an AND-gate 17. It will be understood that the AND-gate 17 can deliver an output signal only when both foil switches A and B are closed. With respect to security requirements, the switching function of the switching arrangement illustrated in FIG. 4 is abolished if only one of the foil switches A and B is opened.

Figure 5:
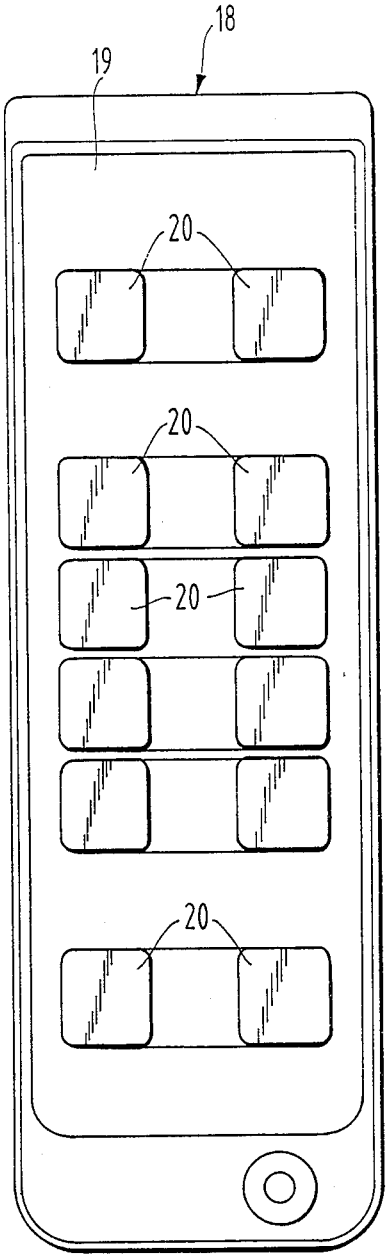
FIG. 5 is a schematic representation of a service device using the switch arrangement of the invention.

FIG. 5, shows a service device for a patient support apparatus with a housing 18 in the upper surface 19 of which are inset a plurality of switch arrangements 20. Each pair of switch arrangements 20, arranged next to one another, serve for the control of one movement function of the patient support apparatus in its two directions. Each of the switch arrangements 20 can be made in accordance with the embodiments of FIGS. 1 to 3. It will be understood that the upper surface of the service device would practically have to be doubled and its operation would be very much more unclear and troublesome if one were to provide two separate switches in the customary manner for each of the switch arrangements 20.

We claim:

1. A switch arrangement for switching electrical functions with at least two switches having electrical contact elements, said switch arrangement comprising a first switch having a flexible base foil carrying a first contact element and also having a switch foil carrying a second contact element, said switch foil being elastically deflectable toward said base foil to bring said first and second contact elements into engagement with one another, and a second switch arranged behind said base foil of said first switch in the keying direction so that said second switch is operable by an operating pressure on said switch foil of said first switch which exceeds the pressure necessary to bring said first and second contact elements of said first switch into engagement, first and second conductors, said first switch being connected in said first conductor to open and close said first conductor and said second switch being connected in said second conductor to open and close said second conductor, and an AND-gate having two input terminals, said first conductor being connected to one of said input terminals and said second conductor being connected to the other of said input terminals.

* * * * *